US005340281A

United States Patent [19]

Su

[11] Patent Number: 5,340,281

[45] Date of Patent: Aug. 23, 1994

[54] PROTECTIVE DEVICE FOR A WATER-PUMP APPARATUS

[76] Inventor: Pai-Tzeng Su, No. 43, Lane 15, Pin-Shan St., Feng-Shan City, Kaohsiung Hsien, Taiwan

[21] Appl. No.: 12,335

[22] Filed: Feb. 2, 1993

[51] Int. Cl.[5] ..... F04B 49/04

[52] U.S. Cl. ..... 417/12; 417/18; 417/40; 417/44 R; 200/84 C

[58] Field of Search ..... 417/12, 18, 36, 37, 417/40, 44 R; 200/84 C

[56] References Cited

U.S. PATENT DOCUMENTS

| | | | |
|---|---|---|---|
| 2,949,126 | 8/1960 | Kuntz et al. | 417/40 |
| 3,469,596 | 9/1969 | Branton | 417/36 |
| 4,736,077 | 4/1988 | Valente | 200/84 C |

*Primary Examiner*—Richard A. Bertsch
*Assistant Examiner*—David W. Scheuermann
*Attorney, Agent, or Firm*—Christensen, O'Connor, Johnson & Kindness

[57] ABSTRACT

A protective device for a water-pump apparatus includes an upright hollow tubular member which is mounted on a top end of a pump unit of the water-pump apparatus, the interior of the tubular member communicating with an interior of the pump unit. A floating switch actuator is provided movably inside the tubular member and floats inside the tubular member in response to water level therein. The switch actuator is provided with a permanent magnet. A control unit is mounted on an outer surface of the tubular member and is connected electrically to a motor unit of the water-pump apparatus. The control unit includes a magnetically actuated switch which is activated by the switch actuator when the switch actuator is at a predetermined position inside the tubular member. The control unit cuts off power supply to the motor unit when the switch actuator ceases to float inside the tubular member.

5 Claims, 6 Drawing Sheets

PROTECTIVE DEVICE FOR A WATER-PUMP APPARATUS

BACKGROUND OF THE INVENTION

1. Field of the Invention

The invention relates to a protective device for a water-pump apparatus, more particularly to a protective device which can prevent idle running of a motor unit of a water-pump apparatus.

2. Description of the Related Art

A water-pump apparatus is usually installed in high-rise buildings so as to pump water from a ground storage reservoir to an elevated tank in order to permit the distribution of water to households of the high-rise building.

Presently, a pump unit of the water-pump apparatus may be operating even when there is no water input thereto, thereby resulting in idle running of a motor unit of the water-pump apparatus. The following are some of the reasons why idle running of the motor unit occurs:

1. The water level of the ground storage reservoir should be above a minimum level in order to ensure proper operation of the water-pump apparatus. Idle running of the motor unit can occur when the water level is below the minimum level and when a water level switch, which is used to control the supply of the power to the motor unit, in the ground storage reservoir is damaged.

2. When water supply from the local water service company is cut-off, and there is no ground storage reservoir, the water-pump apparatus is unable to draw water, thus resulting in idle running of the motor unit.

3. A pipeline interconnects the ground storage reservoir and the water-pump apparatus. When the pipeline is damaged, water does not reach the water-pump apparatus, thus resulting in idle running of the motor unit.

Note that rotation of the rotary parts of the pump unit is continued when the motor unit is running idly. Water serves as a lubricant for the rotary parts. Therefore, when no water is present in the pump unit, locking of the rotary parts can occur. Overloading of the motor unit is possible, thus resulting in overheating and damage to the stator of the motor unit.

In order to overcome the above drawback, a protective device is mounted on the water-pump apparatus to prevent idle running of the motor unit. Referring to FIG. 1, a conventional protective device for a water-pump apparatus includes a pair of bar electrodes (23) which extends into a three-way pipe (22). The bar electrodes (23) are used to detect if water is entering the pump unit (12) of the water-pump apparatus (1). The bar electrodes (23) are connected to a control unit (21) which controls the operation of the motor unit (11) to prevent idle running of the latter. The three-way pipe (22) is connected to the inlet pipe (20) of the pump unit (12). When the three-way pipe (22) has water therein, the pump unit (12) similarly has water therein. There is no resistance across the bar electrodes (23) at this stage, and thus, the control unit (21) permits electrical connection between a power supply (25) and the motor unit (11). Accordingly, when the three-way pipe (22) has no water therein, there is a large resistance across the bar electrodes (23), and thus, the control unit (21) disconnects the power supply (25) and the motor unit (11), thereby preventing the operation of the latter.

It has thus been shown that in the conventional protective device, the presence of water is detected in order to determine whether the control unit (21) should make or break electrical connection between the power supply (25) and the motor unit (11). In order to detect the presence of water, a pair of bar electrodes (23) extends from the bottom of the control unit (21). Therefore, the bar electrodes (23) are normally immersed in water for long periods of time. After a period of use, foreign objects (such as moss) collect at the space between the bar electrodes (23) and can affect the detecting ability of the bar electrodes (23). For example, assuming that the foreign article which gathered between the bar electrodes (23) possesses good electrical conductivity, when the three-way pipe (22) has no water therein to indicate that there is no water in the pump unit (12), the resistance across the bar electrodes (23) is very small, and thus, the motor unit (11) still continues to operate.

Another drawback of the conventional protective device is that it cannot be installed conveniently. During installation, the inlet pipe (20) of the pump unit (12) should be cut to an appropriate length before the three-way pipe (22) can be connected thereto. The control unit (21) is then assembled on top of the three-way pipe (22).

FIG. 2 is a schematic electrical circuit diagram of the control unit (21). The control unit (21) is shown to comprise a transformer, diode rectifiers, voltage regulators and some integrated circuits. The manufacturing cost of the control unit (21) is relatively high because of the relatively large number of circuit components involved. Furthermore, repair of the control unit (21) cannot be accomplished easily because of the large number of circuit components.

It should also be noted that since the bar electrodes (23) are in direct contact with water, water may seep into the control unit (21) if the latter was not sealed properly, thereby causing short-circuiting of the control unit (21).

SUMMARY OF THE INVENTION

Therefore, the objective of the present invention is to provide an improved protective device for a water-pump apparatus which is capable of overcoming the drawbacks that are commonly associated with the prior art.

More specifically, the objective of the present invention is to provide a low cost and easy to install protective device for a water-pump apparatus, a control unit of which being isolated from water.

Accordingly, a protective device of the present invention is to be used with a conventional water-pump apparatus, which has a motor unit and a pump unit driven by the motor unit so as to convey water from a ground storage reservoir to an elevated tank, and comprises:

- an upright hollow tubular member mounted on a top end of the pump unit and communicated with an interior of the pump unit;
- a floating switch actuator provided movably inside the tubular member, said switch actuator floating inside the tubular member in response to water level therein, said switch actuator being provided with a permanent magnet; and
- a control unit mounted on an outer surface of the tubular member and connected electrically to the motor unit, said control unit including a magnetically actuated switch which is activated by the switch actuator when the switch actuator is at a predetermined position inside the tubular member, said control unit cutting off power supply to the motor unit when the switch actuator ceases to float inside the tubular member.

BRIEF DESCRIPTION OF THE DRAWINGS

Other features and advantages of the present invention will become apparent in the following detailed description of the preferred embodiments, with reference to the accompanying drawings, of which.

DETAILED DESCRIPTION OF THE PREFERRED EMBODIMENTS

Figure 1:
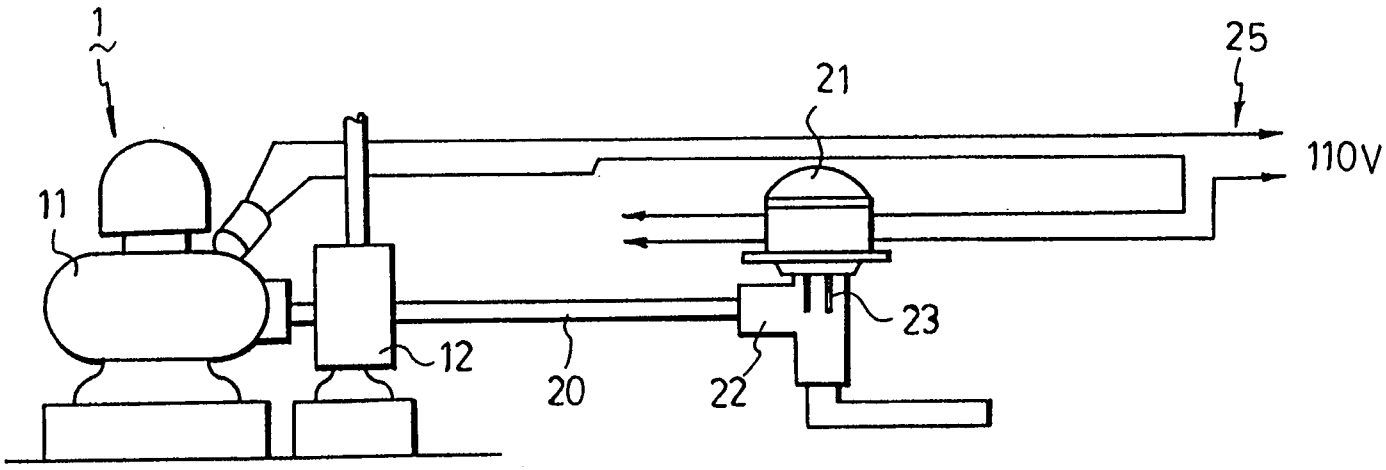
FIG. 1 is a schematic view of a water-pump apparatus with a conventional protective device.
Figure 2:
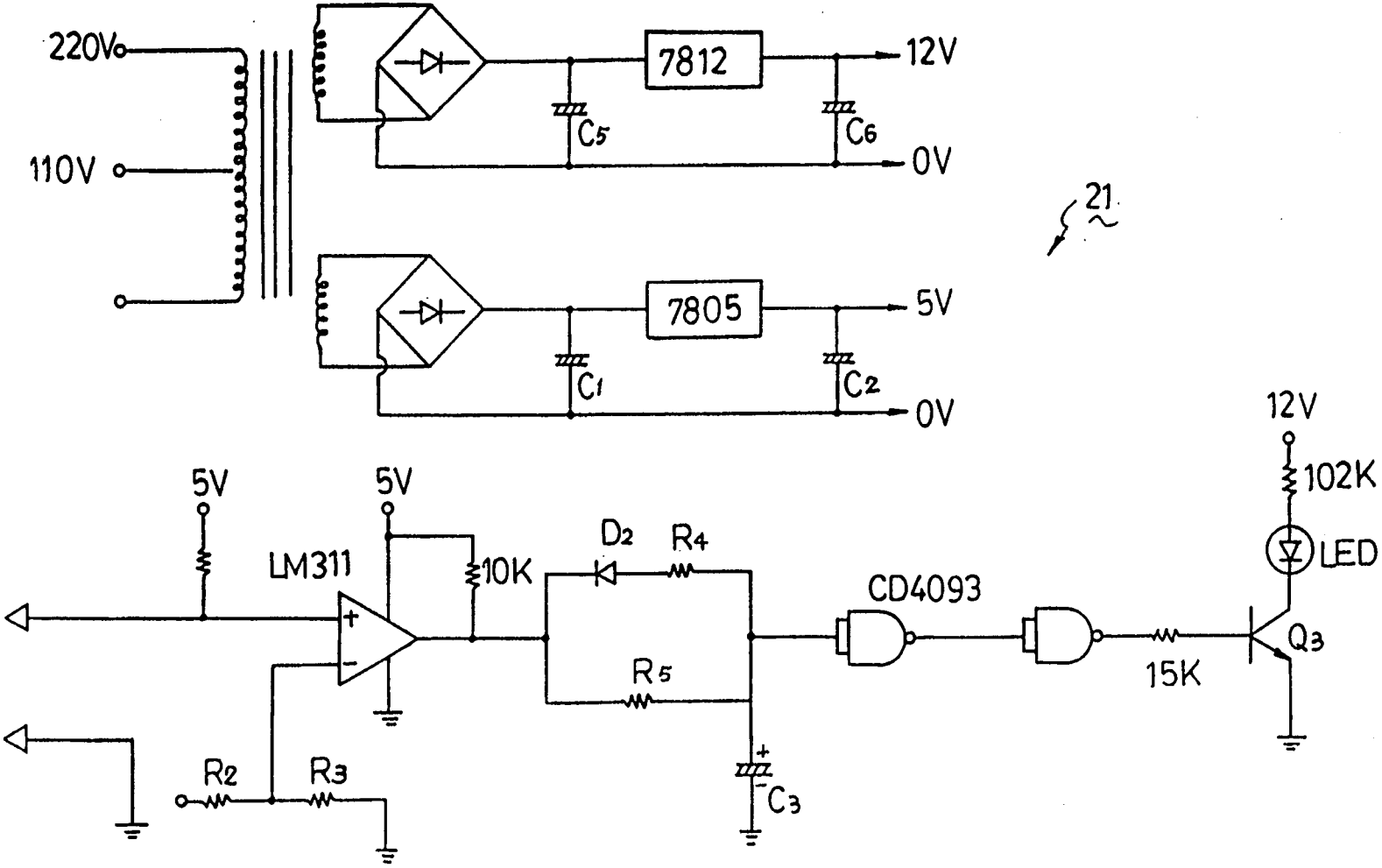
FIG. 2 is a schematic electrical circuit diagram of a control unit of the conventional protective device.
Figure 3:
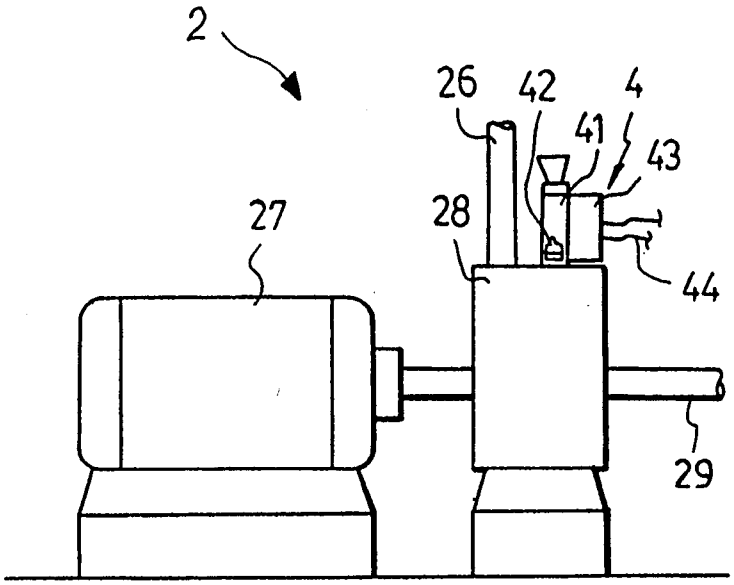
FIG. 3 is a schematic view of a water-pump apparatus provided with the first preferred embodiment of a protective device according to the present invention.

Referring to FIG. 3, the first preferred embodiment of a protective device (4) according to the present invention is to be installed in a conventional water-pump apparatus (2) which comprises a motor unit (27) and a pump unit (28). The motor unit (27) drives the pump unit (28) so as to enable the latter to draw water from a ground storage reservoir (not shown). The pump unit (28) increases the pressure of water which enters an inlet pipe (29) thereof and discharges said water via an outlet pipe (26).

The protective device (4) comprises an upright hollow tubular member (41), a floating switch actuator (42) provided inside the tubular member (41), and a control unit (43) activated by the switch actuator (42). The tubular member (41) is mounted on a top end (282) of the pump unit (28) the interior of the tubular member (41) in fluid communication with the interior of the pump unit (28). The control unit (43) is mounted on an outer surface of the tubular member (41) and is connected electrically to the motor unit (27) by means of electrical wires (44). The control unit (43) is responsible for controlling the operation of the motor unit (27).

Figure 4:
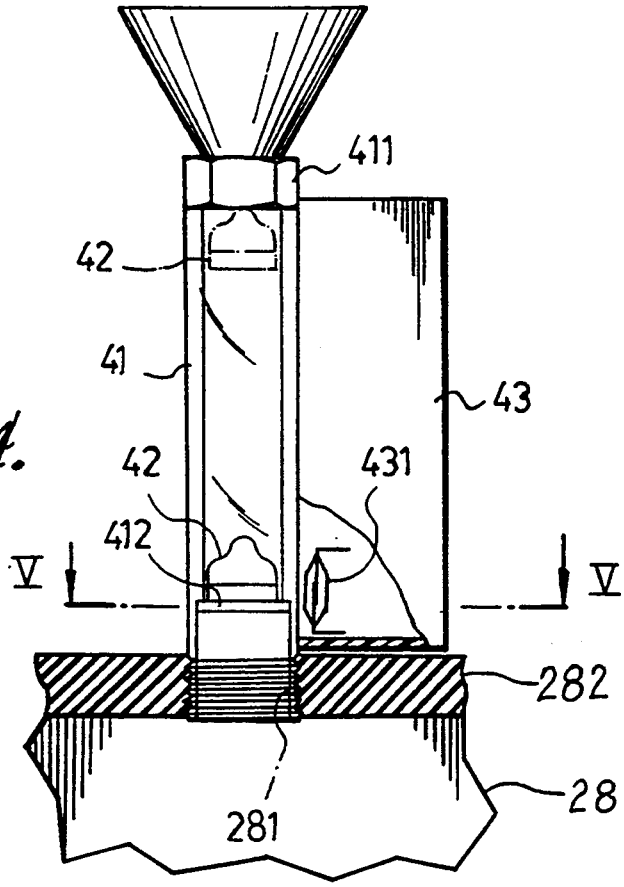
FIG. 4 is an enlarged view of a portion of FIG. 3 to illustrate the first preferred embodiment in greater detail.
Figure 5:
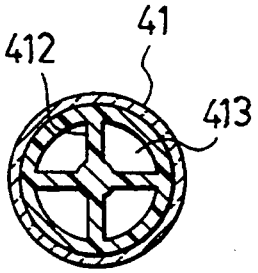
FIG. 5 is a V—V section of FIG. 4.

Referring to FIG. 4, the tubular member (41) is transparent and has a bottom end which is provided with an external screw thread. A stopper (412) is mounted horizontally inside the tubular member (41) adjacent to the bottom end of the latter. The stopper (412) has through openings (413) formed therein, as best illustrated in FIG. 5. The switch actuator (42) is provided inside the tubular member (41) above and adjacent to the stopper (412). Water enters the tubular member (41) via the bottom end of the tubular member (41) and through the openings (413) in the stopper (412), thereby causing the switch actuator (42) to float inside the tubular member (41) in response to water level in the latter. The switch actuator (42) is provided with a permanent magnet. The stopper (412) is used to limit downward movement of the switch actuator (42).

The control unit (43) is provided on the outer surface of the tubular member (41) and includes a magnetically actuated switch (431). In this embodiment, the switch (431) is a magnetic reed switch. The switch (431) is mounted on the outer surface of the tubular member (41) adjacent to the stopper (412). When there is no water in the tubular member (41), the switch actuator (42) rests on the stopper (412) and activates the switch (431). The switch (431) is a normally closed switch which is opened when activated. The bottom end of the tubular member (41) is connected threadedly to a port (281) in the top end (282) of the pump unit (28), thereby communicating the interior of the tubular member (41) with the interior of the pump unit (28). This illustrates how water from the pump unit (28) moves the switch actuator (42). A funnel-shaped cap (411) is mounted on the top end of the tubular member (41). The cap (411) facilitates the introduction of water into the interior of the pump unit (28) when the pump unit (28) is operated for the first time.

Figure 6:
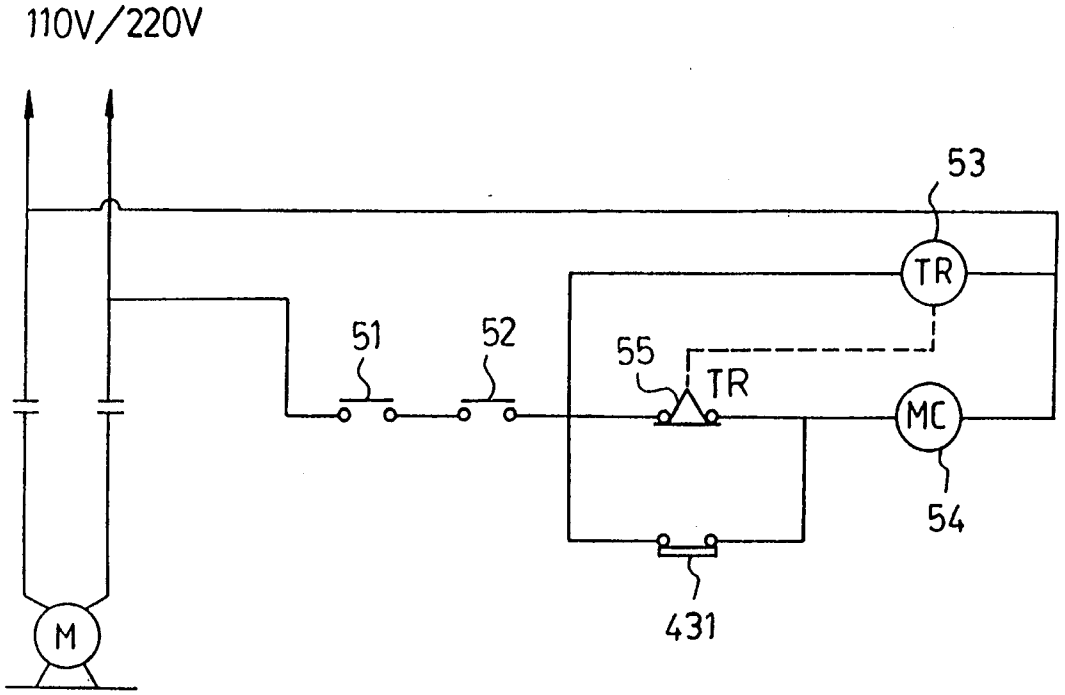
FIG. 6 is a schematic electrical circuit diagram of a control unit of the first preferred embodiment.

FIG. 6 is a schematic electrical circuit diagram of the control unit (43) of the first preferred embodiment. The control unit (43) comprises a first water level switch (51) installed in an elevated tank (not shown), a second water level switch (52) installed in the ground storage reservoir, a timer (53), a timer-activated relay (55), a motor power control unit (54) and the switch (431). The level switches (51, 52) are closed when the water levels inside the elevated tank and the ground storage reservoir are above minimum levels. The timer (53) begins a counting operation, and activates the relay (55) to close the same. In this embodiment, the motor power control unit (54) is a relay unit. When the motor power control unit (54) is energized, operation of the motor unit (27) is permitted so as to enable the pump unit (28) to draw water from the ground storage reservoir. Water in the interior of the pump unit (28) enters the interior of the tubular member (41), thereby causing the switch actuator (42) to float inside the tubular member (41), as shown by the phantom lines in FIG. 4. The switch actuator (42) does not activate the switch (431) at this stage, thereby closing the switch (431). After a predetermined time period (such as 30 to 60 seconds later), the timer (53) deactivates the relay (55), thereby opening the same. Since the switch (431) is closed, the motor power control unit (54) remains energized, thereby enabling the pump unit (28) to continue drawing water from the ground storage reservoir. If, for some reason, the pump unit (28) is unable to draw water from the ground storage reservoir, the water level in the tubular member (41) drops until the switch actuator (42) rests on the stopper (412). The switch (431) is activated, thereby opening the switch (431) to deenergize the motor power control unit (54) so as to stop the motor unit (27) from running. This illustrates how the protective device (4) of the present invention can be used to prevent idle running of the motor unit (27).

Figure 7:
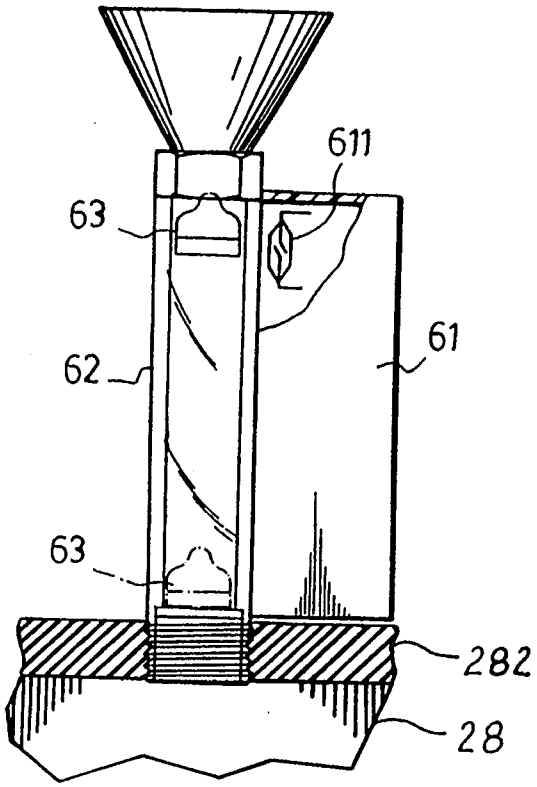
FIG. 7 is a schematic view of the second preferred embodiment of a protective device according to the present invention.
Figure 8:
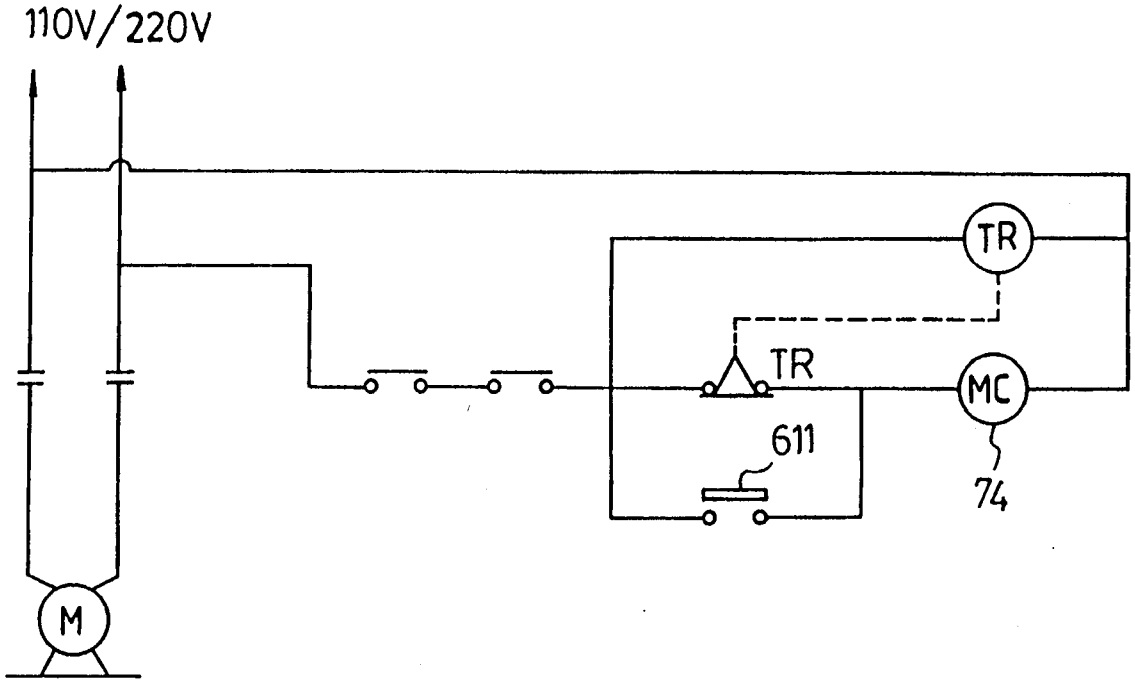
FIG. 8 is a schematic electrical circuit diagram of a control unit of the second preferred embodiment.

FIG. 7 illustrates the second preferred embodiment of a protective device according to the present invention. The second preferred embodiment is substantially similar to the first preferred embodiment except that in the former, the magnetically actuated switch (611) of the control unit (61) is mounted on the outer surface of the tubular member (62) adjacent to the top end of the latter. The schematic electrical circuit diagram of the control unit (61) is shown in FIG. 8. In this embodiment, the switch (611) is a normally open magnetic reed switch. When water enters the tubular member (61), the switch actuator (62) floats inside the tubular member (61), as shown by the phantom lines in FIG. 7. The switch actuator (62) activates the switch (611) at this stage, thereby closing the switch (611) so as to energize the motor power control unit (74) in order to enable the pump unit to draw water from the ground storage reservoir. If, for some reason, the pump unit is unable to draw water from the ground storage reservoir, the water level in the tubular member (61) drops until the switch actuator (62) ceases to activate the switch (611), thereby deenergizing the motor power control unit (74) to stop the motor unit from running.

Note that a transparent tubular member is employed in both embodiments in order to permit observation of the movement of the floating switch actuator. The position of the magnetically actuated switch may be adjusted in order to correspond with the movement of the switch actuator. Furthermore, the transparent properties of the tubular member can help indicate if the pump unit has water therein.

The advantages and characterizing features of the protective device of the present invention are as follows:

1. The operation of the protective device is more accurate than that of the prior art. The protective device of the present invention utilizes the presence of water in the tubular member to move the switch actuator. Therefore, if there is no water in the pump unit, the switch actuator cannot be moved, thereby maintaining the motor unit in an off state. Idle running of the motor unit is thus prevented.

2. The protective device of the present invention is safe to use since the magnetically actuated switch is disposed outside the tubular member and is isolated from the interior of the pump unit. Thus, leakage of water into the control unit is very unlikely.

3. The protective device of the present invention has a simple construction and is easy to assemble. The tubular member is simply threaded to a port of the pump unit, thereby facilitating installation of the protective device.

4. The circuit of the control unit is simpler than that of the prior art, thus resulting in a lower manufacturing cost. Furthermore, repair of the control unit can be easily accomplished.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A protective device for a water-pump apparatus, said water-pump apparatus including a motor unit and a pump unit having a port on a top end thereof, and being driven by said motor unit so as to convey water from a ground storage reservoir to an elevated tank, said protective device comprising:

an upright hollow tubular member coupled to said port on said top end of said pump unit and in fluid communication with an interior of said pump unit through said port;

a floating switch actuator provided movably inside said tubular member, said switch actuator floating inside said tubular member in response to water level therein, said switch actuator being provided with a permanent magnet; and a control unit mounted on an outer surface of said tubular member and connected electrically to said motor unit, said control unit including a magnetically actuated switch which is activated by said switch actuator when said switch actuator is at a predetermined position inside said tubular member, said control unit cutting off power supply to said motor unit when said switch actuator ceases to float inside said tubular member.

2. The protective device as claimed in claim 1, wherein said magnetically actuated switch is a normally closed magnetic reed switch and is mounted on the outer surface of said tubular member adjacent to a bottom end of said tubular member.

3. The protective device as claimed in claim 1, wherein said magnetically actuated switch is a normally open magnetic reed switch and is mounted on the outer surface of said tubular member adjacent to a top end of said tubular member.

4. The protective device as claimed in claim 1, wherein;

said tubular member has a bottom end which is connected threadedly to said port on said top end of said pump unit; and said protective device further comprises a stopper mounted horizontally inside said tubular member adjacent to said bottom end of said tubular member, said stopper having through openings formed therein and limiting downward movement of said switch actuator.

5. The protective device as claimed in claim 1, wherein said tubular member is transparent.

* * * * *